United States Patent [19]

Mathis

[11] Patent Number: 4,742,985

[45] Date of Patent: May 10, 1988

[54] FORMWORK ASSEMBLY FOR A POURED CONCRETE STRUCTURE

[75] Inventor: Hugo Mathis, Bregenz, Austria

[73] Assignee: Rund-Stahl-Bau Gesellschaft m.b.H.

[21] Appl. No.: 798,749

[22] Filed: Nov. 15, 1985

[30] Foreign Application Priority Data

Nov. 16, 1984 [AT] Austria ..... 3642/84

[51] Int. Cl.[4] ..... E04G 11/08

[52] U.S. Cl. ..... 249/193; 249/17; 249/47; 249/153; 249/164; 249/179; 249/184; 249/192; 249/196

[58] Field of Search ..... 249/20, 48, 51, 164, 249/179, 184, 189, 192, 193, 194, 196, 219 R, 17, 47, 153; 425/63

[56] References Cited

U.S. PATENT DOCUMENTS

| | | | |
|---|---|---|---|
| 1,164,319 | 12/1915 | Stieler | 249/17 |
| 1,172,857 | 2/1916 | Wilson | 249/193 |
| 1,334,677 | 3/1920 | Reichert | 249/48 |
| 1,743,136 | 1/1930 | Harrold | 249/192 |
| 2,107,427 | 2/1938 | Schwarzler | 249/189 |
| 2,519,575 | 8/1950 | Huish | 249/189 |
| 3,288,427 | 11/1966 | Plückebaum | 249/192 |
| 4,127,254 | 11/1978 | Kahan | 249/192 |
| 4,185,805 | 1/1980 | Ewing | 249/192 |

FOREIGN PATENT DOCUMENTS

| | | | |
|---|---|---|---|
| 2037059 | 2/1972 | Fed. Rep. of Germany | 249/192 |
| 246374 | 1/1926 | United Kingdom | 17/ |

*Primary Examiner*—Jay H. Woo
*Assistant Examiner*—James C. Housel
*Attorney, Agent, or Firm*—Toren, McGeady & Associates

[57] ABSTRACT

A formwork assembly for a poured concrete structure includes a plurality of formwork panels and girder-like members for supporting the panels. The panels comprise a concrete surface forming sheet and laterally spaced flange-like support members on the outside surface of the panel. The panel sheet is formed of an elastically deformable material so that the panel can follow the configuration of a curved surface of the concrete structure. The support members on the panels are notched or recessed at their ends so that the aligned support members on adjoining panels form a cutout to which the girder-like member is secured.

18 Claims, 10 Drawing Sheets

FORMWORK ASSEMBLY FOR A POURED CONCRETE STRUCTURE

BACKGROUND OF THE INVENTION

The present invention is directed to a formwork assembly for use in constructing structures or parts of structures from a pourable material, such as concrete. The formwork is made up of individual formwork panels constructed of an elastically deformable material, such as steel plates, so that the panels can be bent within their elastic limits for forming the surfaces of curved structures. Flange-like support members are mounted on the outside surfaces of the formwork panels along opposite edges of the panels with the support members being preferably close to the edges. In use, adjoining formwork panels are connected to one another by girder-like members which interlock with the flange-like support members. The girder-like members can act as tension or compression members.

Such formwork is known. With such formwork rotationally symmetrical structures or parts of structures can be constructed and they can also be used to form irregularly curved surfaces in a structure. Different systems are employed for rotationally symmetrical structures or the formwork has to be built for such structures and such formwork systems may be provided with openings therethrough. In a formwork assembly without any openings, the forces generated by the poured concrete are carried by ring-like supports on the inside and outside surfaces of the structure. In the case of an outside formwork section, the transmittal of such forces can be assumed by the formwork surface itself in particular by encircling support members integrated with the formwork panels or by a barrel stave-like assembly and subsequently positioned tension member. The inside formwork is usually supported by compression rings extending along a circular or polygonal path or the inside support may be in the form a simple or three-dimensional lattice structure. If the curved shape is not rotationally symmetrical then up to the present time it has been conventional to construct special formwork usually made up of plywood panels and timber supports and appropriate connecting members.

SUMMARY OF THE INVENTION

Therefore, it is the primary object of the present invention to assemble the formwork so that it can be put together in a simple manner and can be used for structures with straight or curved walls. Adjoining formwork panels within the formwork assembly are connected to one another along their edges by flange-like support members with the formwork panels arranged in horizontally and vertically extending rows.

In accordance with the present invention, the flange-like members are provided with notches or cutout sections at their ends so that such notches or cutout sections in the support members on adjoining formwork panels define groove-like cutouts through which girder-like members can be inserted at right angles to the long direction of the support members.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

BRIEF DESCRIPTION OF THE DRAWING

In the drawing:

FIG. 36 is a view of a formwork panel similar to that shown in FIG. 3 illustrating the flange-like support members detachably secured to the formwork panel;

DETAILED DESCRIPTION OF THE INVENTION

Figure 1:
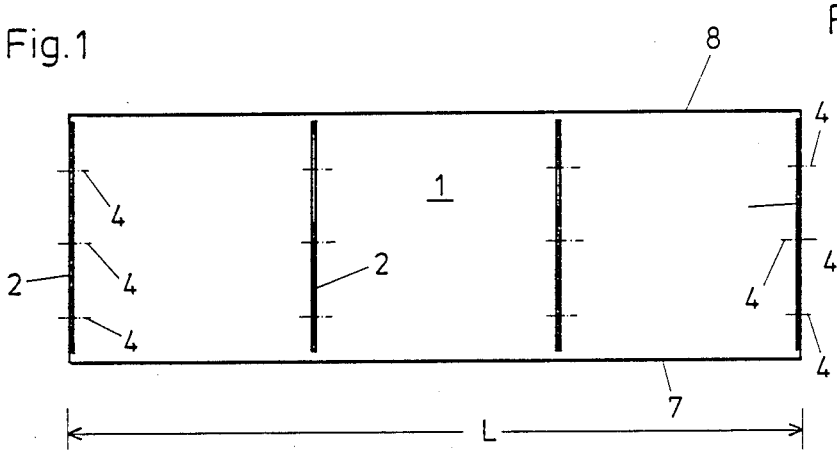
FIG. 1 is an elevational view of a formwork panel.
Figure 3:
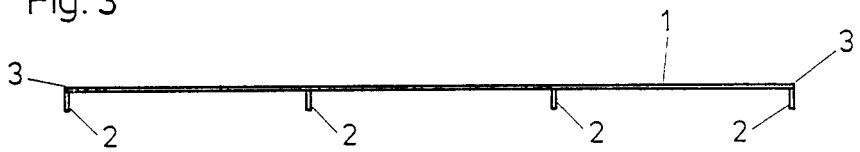
FIGS. 3, 4, 5 & 6 are plan views of the formwork panel illustrated in FIG. 1 indicating different curved shapes for the panel.
Figure 4:
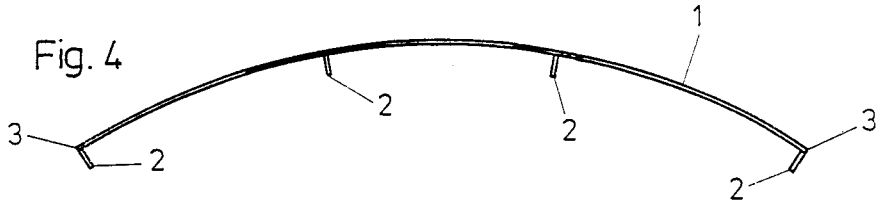
Figure 5:
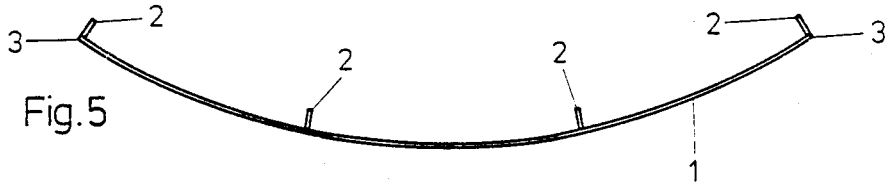
Figure 6:
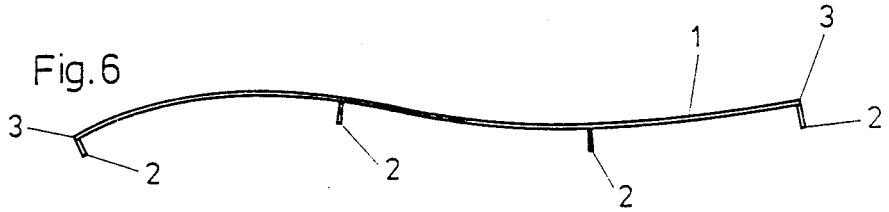

In FIG. 1 an elevational view of the outside surface of a formwork panel 1 is shown. The panel is rectangularly shaped and is longer in the horizontal direction than in the vertical direction. The surface of the panel viewed in FIG. 1 is the outside surface, the opposite or inside surface forms the surface of the structure to be poured. The formwork panel 1 is constructed of a flexible sheet steel plate. The plate forms the inside and outside surfaces of the panel. Four vertically extending flange-like support members 2 are secured on the outside surface of the plate and are disposed parallel to one another. The support members 2 extend in the vertical direction with a web extending along each of the vertically extending edges 3 of the plate. The support members 2 extending along the vertically extending edges 3 are flush with these edges. In FIG. 3 the formwork panel 1, ready to be assembled in position, is planar, that is, the inside surface of the panel defines a flat or planar surface. The panel, however, can be bent into a variety of curved shapes, note FIGS. 4–6.

Figure 2:
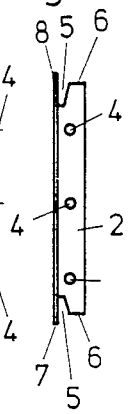
FIG. 2 is an end view of the panel in FIG. 1.

As can be seen in FIGS. 1 and 2 openings 4 extend through the support members 2 spaced uniformly along the vertical direction or height of the support members. Connector members, not shown, can be inserted through the openings 4 for interconnecting the adjoining ends of the formwork panels 1 arranged in a formwork assembly. At the upper and lower end of the support members 2, wedge-shaped notches 5 are provided, note FIG. 2, whereby the wedge-shaped notches are defined in part by the end of the support members and by the outside surface of the formwork panel. The upper and lower ends 6 of the support members 2 are offset slightly inwardly from the corresponding long or horizontally extending edges 7, 8 of the panel 1. Preferably, the formwork panels 1 have a length dimension L of 3.14 m or a multiple of the given length or an equally divided part thereof, such as 1.57 m, 52 cm or the like. The sheet metal plate forming the surface of the panel is approximately 50 cm to 100 cm high, that is in the vertical direction, and the plate is flexible in its elongated or horizontal direction.

The other principle element of the formwork is a girder-like member which can be stressed in tension or compression and, in the case of circular formwork, is ring-shaped.

Figure 7:
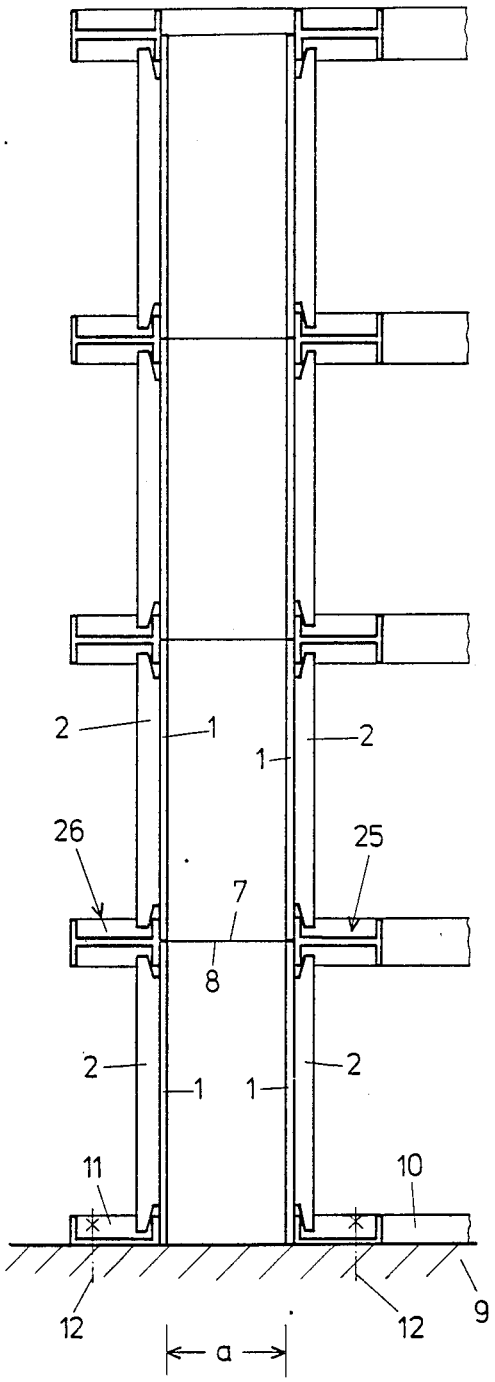
FIG. 7 is an elevational view through a formwork assembly used for pouring a circular wall structure.

In FIG. 7 a cross-sectional view is afforded through a formwork assembly for a circular structure with the assembly being made up of the formwork panels 1 described above. The circular structure extends vertically upwardly from a foundation 9. Two rings formed of U-shaped or channel structural sections 10 are secured by bolts 12 to the foundation 9. The two rings or the channel sections are spaced apart so that the panels are spaced from one another by a distance a corresponding to the thickness of the wall to be poured within the formwork so that the webs of the channel sections 10, 11 bear directly against the surface of the foundation 9. The arrangement of the channel sections 10, 11 on the foundation 9 is shown in an enlarged detail view in FIG. 22 as compared to FIG. 7. In place of the channel sections shown in FIG. 22, it would be possible to use a ring constructed from L-shaped or angle sections 13, such as is shown in FIG. 23.

Figure 18:
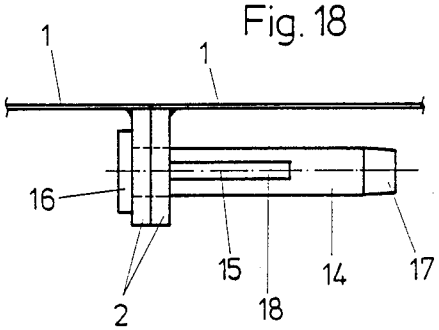
FIGS. 18 & 19 are plan views showing locking members for formwork panels with the panels extending in the horizontal direction.
Figure 19:
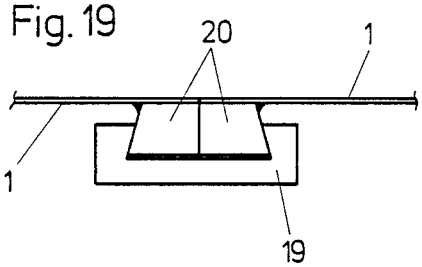
Figure 20:
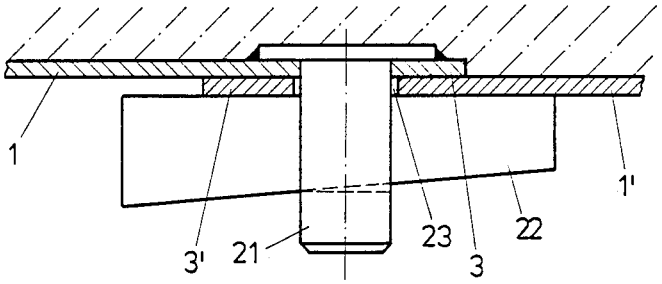
FIGS. 20 & 21 illustrate sectional views through the connecting locations of formwork panels extending in a horizontal row.
Figure 22:
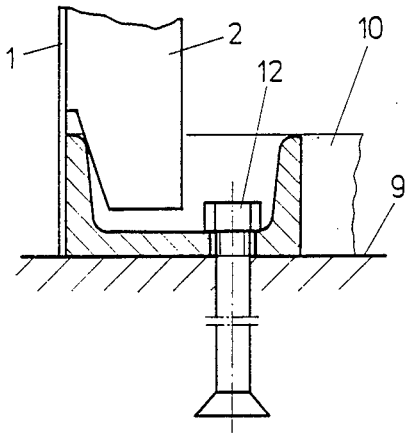
FIGS. 22 & 23 are sectional views of the attachment of the formwork panels to a foundation.
Figure 23:
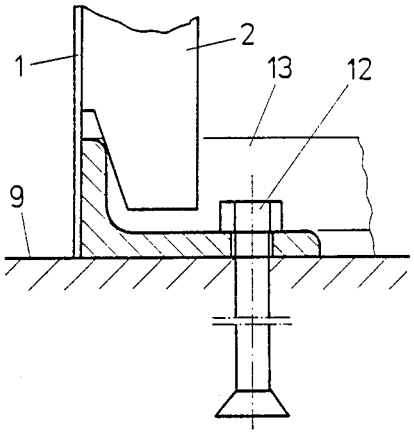

With the ring-shaped channel sections 10, 11 secured on the foundation 9, the individual formwork panels 1 are placed on the adjacent legs of the channel sections 10, 11 which extend vertically with the legs extending into the wedge-shaped notches or cutouts 5 in the lower ends of the support members 2, note FIGS. 22 and 23. The panels are fitted onto the channel sections in the horizontal direction so that a horizontally extending row of the formwork panels 1 are connected together to form a ring. Adjoining formwork panels in the horizontal row can be secured together with pins 14 and wedges 15 as displayed in FIG. 18. The pin 14 has a shank 17 with a conically shaped end and head 16 extending transversely outwardly from the shank. A slit-like opening 18 is provided in the pin shank 17 for receiving the clamping key or wedge 15. The pin 14 is placed through aligned openings in the adjoining support members 2 with the wedge key 15 securing the edges of the formwork panels 1 together when it is driven into the slit opening 18. In place of such a pin, it would be possible to use the arrangement illustrated in FIG. 19 where a shoe 19 with a dove-tailed groove fits over a pair of corresponding shaped fishplates 20 secured along the adjacent vertical edges 3 of the formwork panels 1, the corresponding shape of the dove-tailed groove and the sides of the plates 20 draws the vertical edges of the panels 1 into abutment. In the two embodiments shown in FIGS. 18 and 19, the vertical edges 3 of the formwork panels 1 are in contact or abut one another In FIG. 20 another connector is shown for securing the formwork panels together in a horizontal row. In this embodiment, the vertically extending edge of the panel 1 has several spaced bolts 21 welded on so that they extend from the outside surface of the panel and are spaced apart in the vertical direction. Each bolt 21 has an oblong hole extending therethrough into which a clamping key or wedge 22 can be secured. The edge 3' on the other formwork panel 1' has a series of holes 23 each arranged to receive one of the bolts 21. With the bolts 21 extending through the holes 23 and with the wedges 22 secured through the holes 23 the two panels are secured together with the vertical edge 3' of the panel 1 overlapping the outer vertical edge 3' of the panel 1'. As a result, a stepwise joint is provided in the formwork assembly.

Figure 21:
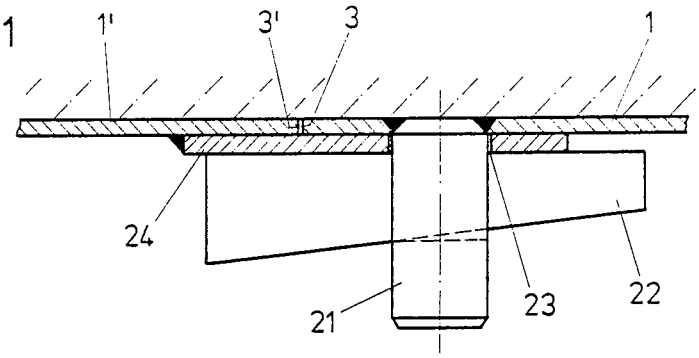

If the stepwise offset of the edges of the formwork panels adjoining one another in the horizontal direction is considered inappropriate or disadvantageous, a similar connection can be effected without such an offset. In FIG. 21 a similar arrangement to that shown in FIG. 20 with similar reference numerals is displayed. In this embodiment, the holes 23 are arranged in a plate 24 welded to the outside surface of the panel 1' with the holes 23 spaced apart in the vertical direction in the plate. The plate 24 extends from the outside surface of the panel 1' across the joint between the adjoining panels to a location spaced from the other side of the joint. The bolts 21 are secured to and extend outwardly from the outside surface of the formwork panel 1 and are positioned so that they extend through the holes 23 in the plate 24. With the vertical edges of the panels 3' and 3 arranged in abutment and with the bolts 21 extending through the plate 24, the wedge 22 is positioned through the slit-openings in the bolts for securing the adjoining panels together.

Referring again to FIG. 7, after the first stage of the formwork panels 1 are positioned, the ring-shaped girder-like members 25, 26 are inserted in the upper ends of the notches 5 in the flange-like support members 2 of the first stage. The outer ring girder-like member 26 forms a tension ring while the inner ring girder-like member 25 acts as a compression ring. The notches 5 in the support members 2 receive the flanges of the girder-like member which face toward the formwork in a positively locking manner. The next stage of formwork panels 1 are positioned on the girder-like members 25, 26 with the formwork assembly continuing to be erected in the vertical direction and aligned in the circumferential direction. This procedure is repeated until the formwork assembly reaches the required height. As can be noted from FIG. 7 and in particular from FIG. 8, the notches 5 in the adjacent ends of the webs 2 aligned in the vertical direction form an undercut groove which grips the flange of the annular shaped girder-like member facing toward the formwork panel and affords a positive lock.

Figure 8:
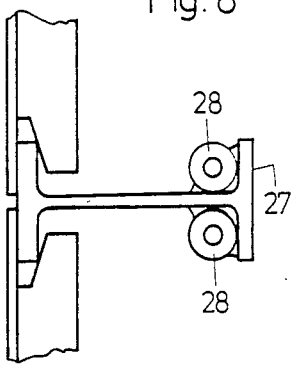
FIGS. 8, 9, 10, 11, 12 and 13 are end or side views of differently shaped girder-like members which can be used as tension members in the formwork assembly displayed in FIG. 7.
Figure 9:
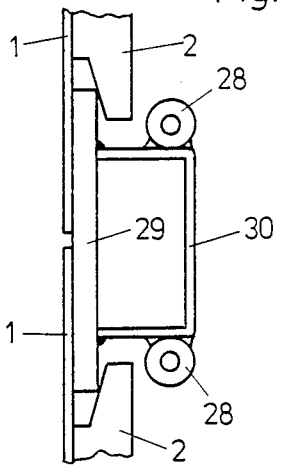

The ring-shaped or angular girder-like members 25, 26 can be constructed in different shapes. Appropriately, however, they are made up of individual ring segments which are clamped together. The cross-sectional shape of these girder-like members can be quite different. In FIG. 8 an I-beam shaped member is illustrated with sleeves 28 welded on to the web of the girder-like member at the outer flange, that is, the flange spaced outwardly from the formwork panel. The axes of the sleeves 28 extend parallel to the axis of the girder-like member. In FIG. 9 the girder-like member is built up from a steel plate 29 bearing against the outside surfaces of the adjoining panels 1 with a U-shaped section 30 welded to the outwardly facing surface of the plate 29 so that a box section is formed. Sleeves 28 are secured to the outside surfaces of the box section which extend perpendicularly outwardly from the plate 29.

Figure 10:
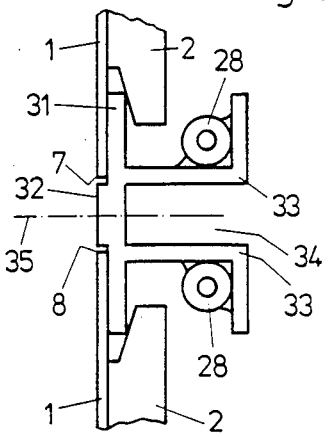

In FIG. 10 a more complicated and costly structure is shown for the girder-like member. In this embodiment, a flange 31 bears against the outside surfaces of the adjacent formwork panels 1. The horizontally extending edges 7, 8 of the panels 1 are spaced vertically apart and the flange 31 has a block-like protrusion 32 located in the space between the edges 7, 8. The outside surface of the flange 31 has two spaced L-shaped or angle sections 33 with the outer legs extending away from one another. The angle sections 33 define a central intermediate space 34 in which spacer members can be inserted for spacing the formwork panels apart. Such spacers are indicated by the dotted line 35. The girder-like member depicted in FIG. 10 and described above can be a rolled section.

Figure 11:
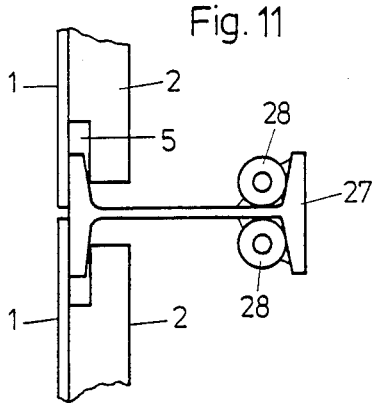

In FIG. 11 the girder-like member resembles the one shown in FIG. 8, however, in this figure the notches 5 are defined by surfaces extending at right angles to one another while the flanges of the I-beam section have a wedge-shaped surface. The required clamping action between the girder-like member and the formwork panels is obtained by the wedge-shaped cross-section of the flanges 27.

Figure 12:
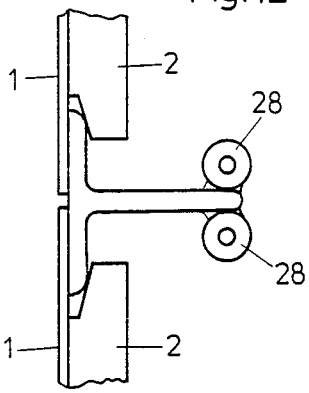
Figure 13:
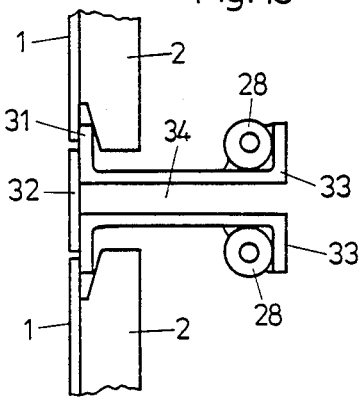

In FIG. 12 the girder-like member is formed from a T-shaped structural section with the head of the T bearing against the outside surfaces of the formwork panels and with the shaft of the T projecting outwardly from the head. The girder-like member in FIG. 12 can be a rolled section. In FIG. 13 the girder-like member resembles the one shown in FIG. 10 and is built up of a plate section 32 and individual channel sections 33.

The T-shaped structural section shown in FIG. 12 is primarily intended for use as a tension ring so that these members would be located on the radially outer side of a ring-shaped formwork assembly.

Figure 14:
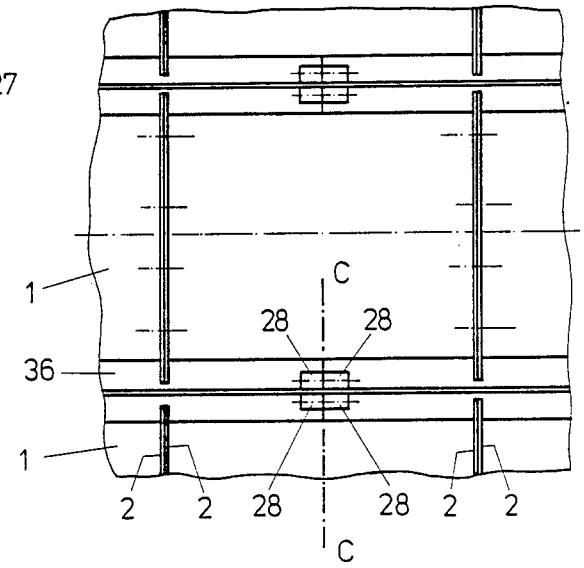
FIG. 14 is a partial elevational view of a formwork assembly showing the tensioned side of the formwork using the girder-like member depicted in FIG. 15.
Figure 15:
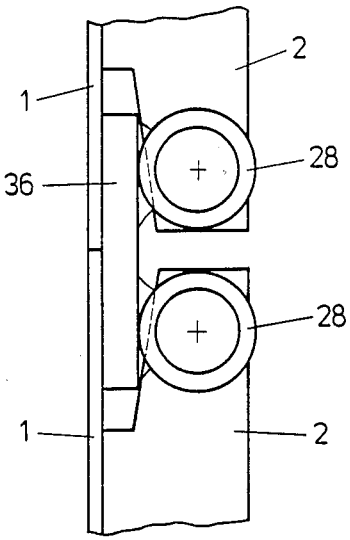
FIG. 15 is a transverse view of the girder-like member shown in FIG. 14.

In a situation where lower stresses are encountered, a simple steel strip or plate section 36 can be used as the tension element, such as illustrated in FIGS. 14 and 15. In this embodiment sleeves 38 are welded on the face of the plate 36 facing outwardly away from the panels 1. The sleeves 38 are used for receiving connecting and clamping bolts or the like. The junction between adjoining sections of the girder-like member is shown in FIG. 14, and FIG. 15 is a section taken along the line C—C in FIG. 14.

Figure 16:
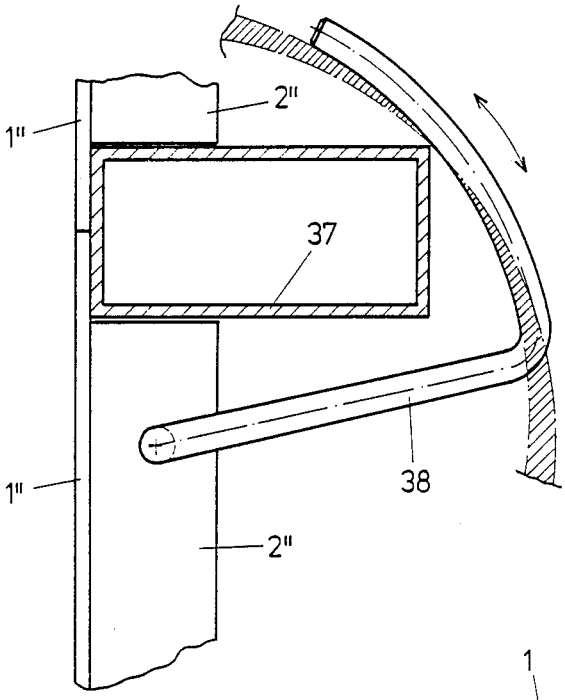
FIG. 16 is a transverse view, partly in section, of the girder-like member in the form of a box girder.
Figure 17:
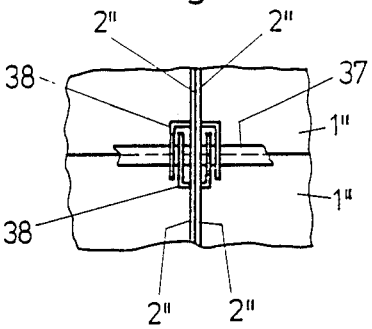
FIG. 17 is an elevational view of the girder-like member shown in FIG. 16 and illustrated on a reduced scale.

In the previously described figures the support members for the formwork panels are shown with notches at their ends so that aligned support members provide a pair of notches 5 which in combination define an undercut groove for the flanges of the horizontally arranged girder-like members so that a positive lock is provided. Most of the notches 5 have wedge-shaped surfaces, however, the notches can also be defined by surfaces extending at right angles to one another, such as in FIG. 11. In FIG. 16 the combination of the support member 2'' and the outside surface of the panel 1'' provide a recess so that aligned support members 2'' define a groove. In FIG. 16 the girder-like member is defined by a box-like member 37 made up of a number of individual longitudinally extending sections. The sections are secured together by eccentric brackets pivoted to the support members 2''. After the box-like member 37 has been inserted into the groove, the brackets 38 are pivoted into position to hold the box-like member tightly against the formwork panels. The brackets 38 afford a clamping action. As can be seen in FIG. 17, the brackets are pivoted to the support members 2'' above and below the box-like member 37 so that the combination of the brackets hold the box-like member in a pincer-like manner. Note FIG. 17 which is an elevational view of FIG. 16 but on a reduced scale.

Figure 24:
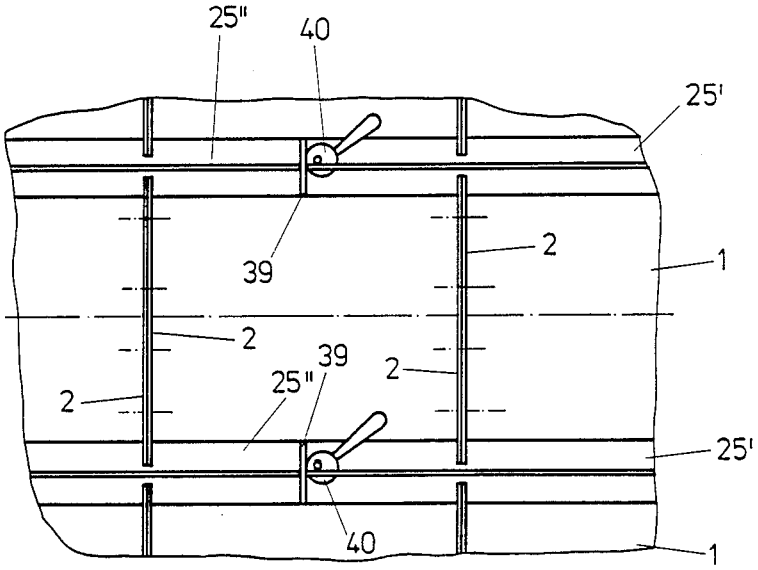
FIG. 24 is an elevational view of the connection of horizontally extending girder-like members acting as compression members.
Figure 26:
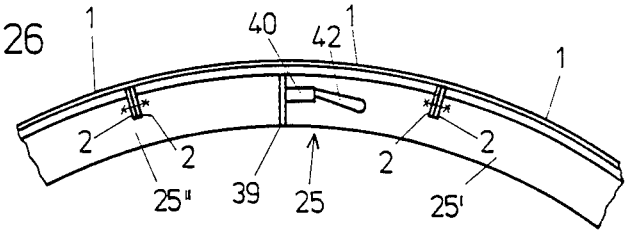
FIG. 26 is a plan view of the connection shown in FIG. 24.
Figure 25:
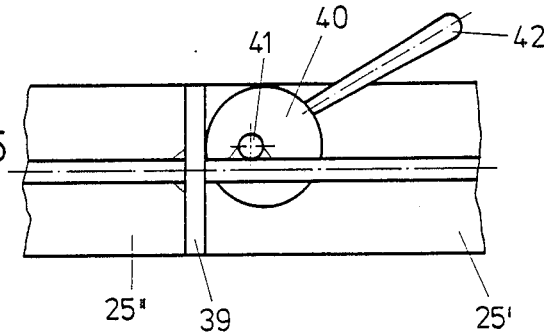
FIG. 25 is an enlarged detail view of the connection shown in FIG. 24.

Above girder-like member sections have been described which can be bolted together, and where the girder-like members are used as tension members such bolted connections are required. On the other hand, if the girder-like members are used as compression members, such a bolted connection is not necessary. An example of a connection between girder-like member sections is displayed in elevational view and plan view in FIGS. 24, 25 and 26. The girder-like member 25 acting as a compression member is in the form of a T-shaped section and is made up of individual arc-shaped sections 25' and 25''. As viewed in FIG. 24, the end of the girder-like member section 25'' is provided with a pressure plate 39 arranged at right angles to the axis of the section and it is solidly connected with the section, such as by welding. The other section 25' has an eccentric 40 at its end abutting against the pressure plate 39. The eccentric 40 is pivoted about a fixed axis 41 by a hand lever 42. The girder-like member sections are inserted into the undercut grooves formed by the notches 5 in the webs and are held together by positioning the eccentric 40.

Figure 27:
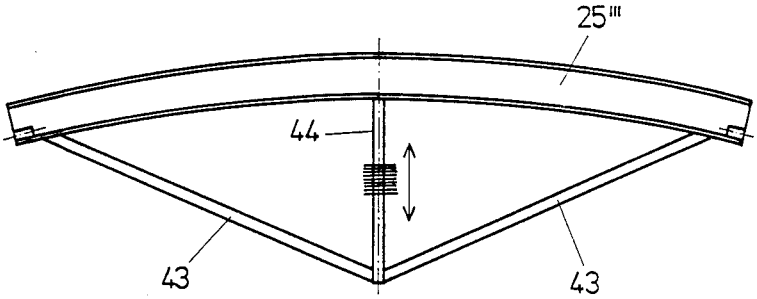
FIG. 27 illustrates a curved girder-like member in plan view.
Figure 29:
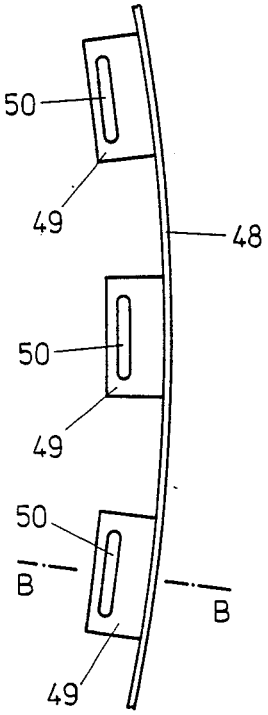
FIG. 29 is a plan view of one part of the girder-like member displayed in FIG. 28.

All suitable members can act as girder-like members or girder-like member sections if they include an appropriate strip-like member which can engage within the undercut groove formed by the notches 5 so that a positive lock is effected. The individual girder-like member sections can be pre-bent, however, girder-like members can be employed which are adjustable to a desired curvature. Girder-like members which can be adjusted to various curvatures are generally known in a variety of shapes. One such shape is shown in plan view in FIG. 27. The opposite ends of a girder-like member section 25''' are interconnected by a combination of elongated tension rods 43 and an adjustment link 44 extending from the section outwardly to the intersection of the ends of the tension rod spaced outwardly from the section. The adjustment link has a variable length. By changing the length of the adjustment link 44 the curvature of the girder-like member section 25''' is adjustable. Girder-like member sections which form a polygonal ring are also usable.

Figure 28:
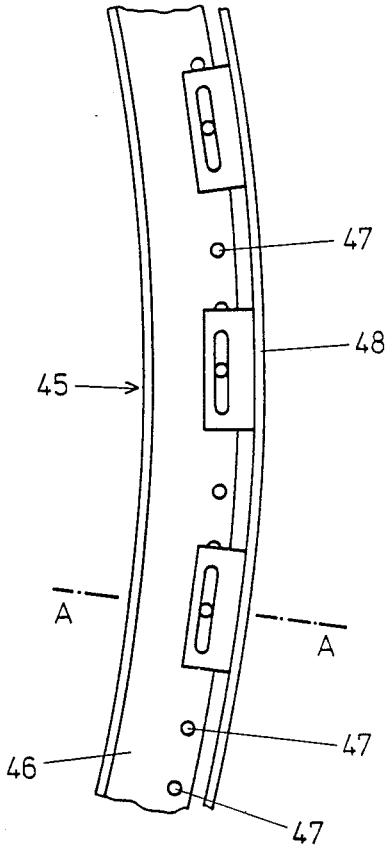
FIG. 28 is a curved girder-like member shown in plan view and made up of several parts.
Figure 31:
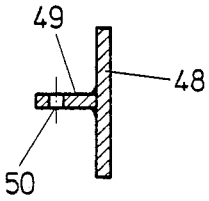
FIG. 31 is a cross-sectional view taken along the line B—B in FIG. 29.
Figure 30:
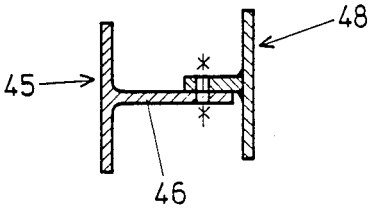
FIG. 30 is a cross-sectional view taken along the line A—A in FIG. 28.

Another embodiment of the girder-like member is displayed in FIGS. 28 to 31. The girder-like member shown in FIGS. 28 and 30 is made up of two parts. One part is a curved T-shaped structural section 45 with a shaft extending from the head of the T, provided with a row of holes adjacent the end of the shaft spaced from the head. The second part of the girder-like member is a steel strip 48 with a web 49 welded centrally to one surface of the strip 48. Elongated holes 50 are provided in the web 49 with the holes being spaced from the strip 48. The strip 48 is very flexible and can be used as a tension member. Along with the T-shaped section 45 in FIG. 28, it can be employed as a compression member. Accordingly, as shown in FIGS. 28 and 30 the strip 48 and its web 49 can be bolted to the T-shaped section 45.

In the embodiments described above, the formwork panels positioned one above the other are aligned so that the support members 2 are aligned vertically. This is not an absolute requirement for the invention. The support members 2 of the formwork panels 1 extending one above the other in the vertical direction can be offset. In such an instance, the horizontal girder-like members are retained in a positively locked manner without regard to whether they are circular or polygonally shaped ring-shaped members.

In constructing a circularly shaped formwork assembly, for instance the radially outer formwork section, the described formwork panels are inserted into an aligning device attached to the foundation as described with regard to FIGS. 22 and 23. The rings of formwork panels are disposed in butt-jointed relation Since the notches in the ends of the support members have been arranged for receiving horizontally extending girder-like members, the girder-like member for an outside formwork section experiences tensile forces generated when concrete is poured into the formwork assembly. At the same time, the girder-like member provides the seal of the junction between two formwork panels located one above the other. Due to the wedge shape of the notches or the wedge shape of the flanges on the girder-like members, the individual panels can be aligned and fixed in position. The formwork assembly is continued by placing rings of the formwork panels and the ring-shaped girder-like members until the desired height has been attained. After placing the requisite reinforcement for the structure to be poured, the radially inner or inside formwork section is built in the same manner so that it forms a closed surface for receiving the poured concrete. It is possible to employ combined girder-like members instead of purely tension and compression girder-like members which permit a transverse connection so that the total load is distributed between the inner and outer girder-like members. In such an arrangement, the girder-like members are designed as U-shaped sections, note FIGS. 10 and 13. The girder-like members disposed on the inside or the outside must be adjusted to the required radius of curvature of the structure to be poured. The girder-like members can also be arranged in a polygonal form. To prestress the compression as well as the tension girder-like members, the girder-like members can be designed so that they include eccentric, or wedge-like or bolted connections with which the desired prestressing forces can be developed. The formwork assembly embodying the present invention permits the concrete to be poured to any desired height. It is also possible, depending on the progress of the construction, to strip the formwork in the region where the concrete has set and thus re-use the formwork panels at the upper part of the formwork assembly.

In accordance with the present invention, it is possible selectively to erect the inside formwork section first, then place the reinforcement and finally erect the outside formwork section. As mentioned above, this procedure can be reversed with the outside formwork section being erected first. Due to the stabilizing effect of the girder-like members, only one inner or outer scaffolding arrangement is necessary for erecting the formwork and similar to scaffolding which is already in use with known formwork assemblies. It should be noted that such scaffolding can be supported against the inside girder-like members. The formwork constructed in this manner has sufficient stability so that additional stiffening or bracing members are not required. Spacer members extending between the inside and outside formwork panels can be inserted.

In structures to be formed which are not rotationally symmetrical, the horizontal girder-like members are provided in accordance with the intended curvature in the form of through binding girder-like members. Then the formwork assembly is built up alternately with flexible formwork panels in the same manner as for the cylindrically shaped formwork. After the buildup the required through binding devices can be introduced.

Preferably, the flexible formwork panels are fabricated from steel sheets or plates. It is also possible to use other materials, such as glass fiber reinforced plastics or glass fiber reinforced girder-like members. Plywood can also be used.

The great variety of horizontally extending girder-like members has already been shown. Further, different sections can be used for the girder-like members forming the support for the radially inner and outer sides of the formwork assembly.

As compared with known formwork, the flexible formwork according to the present invention has the advantage that the horizontal girder-like member as well as the formwork panels are flexible in both directions and, therefore, can be employed for circularly symmetrical inner formwork sections as well as circularly symmetrical outer formwork sections. The parts making up the formwork assembly are provided with a simple structural shape and can be easily maintained in proper condition and easily cleaned. This, of course, applies not only to the formwork panels but to the horizontally extending girder-like members which are preferably connected to one another so that they can be continuously fed through a bending machine. The bending of the girder-like members can be performed at the construction site or it can be carried out in the factory.

A variety of supports can be placed on the stiff horizontal girder-like members so that a platform can be provided on the supports. The formwork can also be employed as a self-climbing formwork. Accordingly, a formwork section of approximately two meters in height can be constructed, the concrete is poured and then the process is repeated upwardly towards the top of the structure being built. After completing one horizontally extending stage, the formwork is moved upwardly to construct the next stage. The formwork as described is basically easily penetratable.

With the present invention, the elevation or height of the formwork assembly can be raised to any random height without the fall of the concrete being greater than the height of the formwork assembly.

In constructing the formwork, it is also possible to utilize a hydraulically elevatable platform which can be supported on the horizontally extending girder-like members and then moved upwardly in a stepwise manner. In the formwork panels described above, the support members 2 are welded on and the notches or cuts in the ends of the support members can be formed prior to the welding step. In accordance with the present invention, the interconnection afforded by the notches or cuts can also be affected by removable connectors. One such embodiment is displayed in FIGS. 32 and 33. The support member 61 is welded on to the back of the formwork panel 60. A rectangular recess is provided in the support member 61 adjacent its end with the long direction of the recess extending parallel to the long direction of the support member. A wedge 63 having a fork-like shape, note FIG. 33, is displaceably positioned in the recess 62. The arrow 67 in FIG. 32 indicates the direction in which the wedge 63 can be displaced. The wedge 63 can be slid over the full length of the recess 62. With this connector arrangement it is possible to line up the formwork panels 60 then insert or place the girder-like member 64 and then effect a positively locked joint by displacing the wedge 63 so that it grips the flange 65 of the girder-like member 64 in a positive locking manner.

Figure 32:
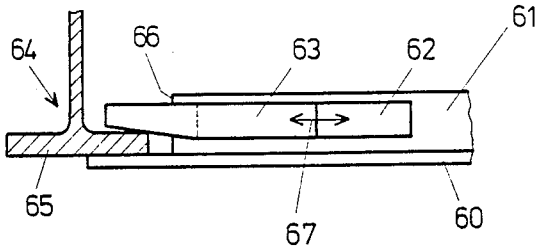
FIGS. 32 to 36 are cross-sectional views of different embodiments of the connection between the formwork panels and the girder-like members with FIGS. 32 and 34 viewed in an elevational section and FIGS. 33 and 35 viewed in section taken transversely of the section shown in FIGS. 32 and 34.
Figure 33:
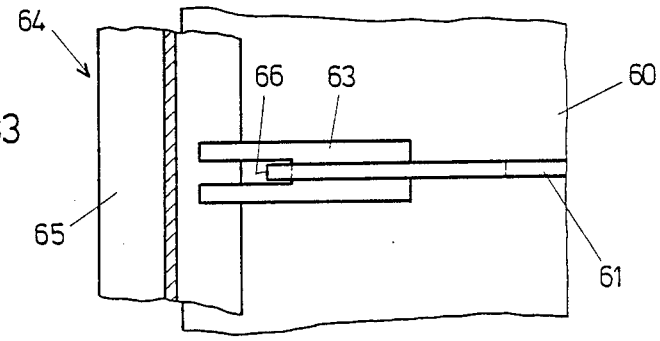
Figure 34:
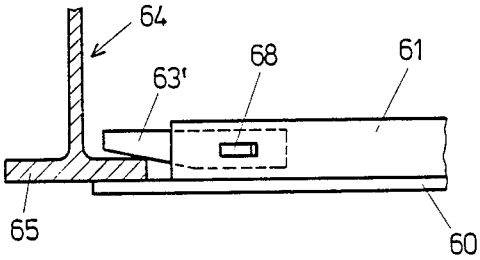
Figure 35:
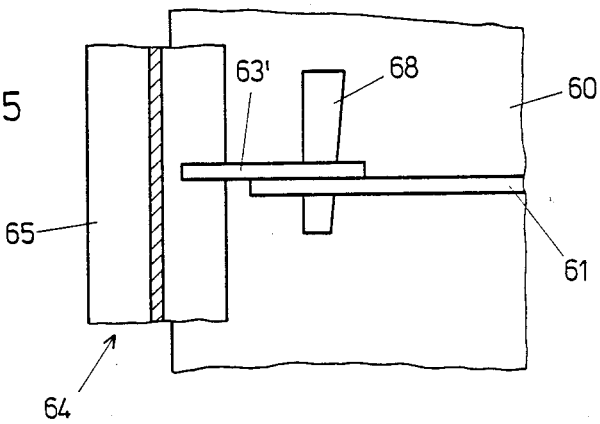

Another embodiment of the connector arrangement shown in FIGS. 32 and 33 is set forth in FIGS. 34 and 35. In this embodiment, a displaceable wedge 63' which lock the flange 65 of the girder 64 is fixed in position by an addditional wedge 68 which can be inserted into corresponding openings in the support member 61 and the wedge 63'.

The embodiments in FIGS. 32 to 35 have the advantage that the formwork panels can be aligned and then the girder-like members 64 can be placed and then locked by the sliding-in or driving-in of the wedges 63 or 63' for effecting the desired locking action.

Figure 36:
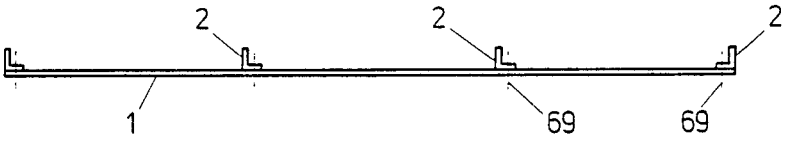
Figure 37:
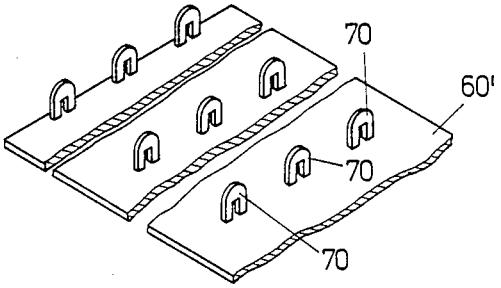
FIG. 37 is a perspective view of another arrangement of the embodiment shown in FIG. 36.
Figure 38:
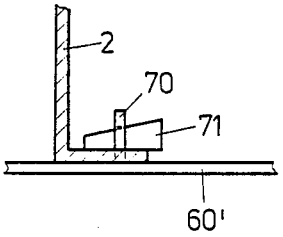
FIG. 38 is a sectional view showing the connection of the flange-like support member in FIG. 36 to the connectors shown in FIG. 37.

In FIG. 36 there is a formwork panel 1 similar to that shown in FIG. 3, however, in this embodiment the support members 2 are made of L-shaped or angle sections and are detachably secured by means of bolts. The bolts are indicated by the dotted lines 69. FIGS. 37 and 38 show another embodiment for the detachable fastening of the support members 2. In this embodiment, rows of bracket-shaped eyes or loops 70 are positioned on the formwork panel 60'. The angle sections serving as the support members 2 have spaced openings in one of their legs arranged to receive the eyes 70. For a secure connection of the two parts, that is, the formwork panel 60' and the support members 2, wedges 71 can be inserted through the eyes 70 for locking the support members on the formwork panel.

Figure 39:
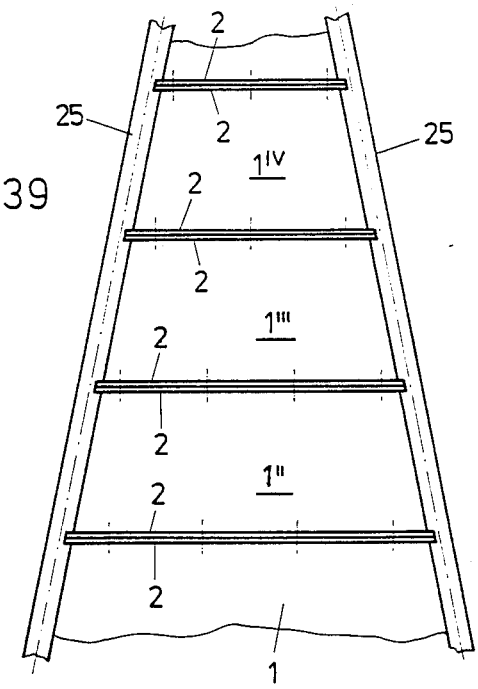
FIG. 39 is an elevational view of trapezoidally shaped formwork panels and girder-like members with the panels having a trapezoidally shaped edge contour with the flange-like support members extending horizontally.

The formwork panels described above and illustrated in the drawing are rectangularly shaped, however, it is also possible to provide trapezoidally shaped panels. A formwork section made up of trapezoidally shaped formwork panels is displayed in FIG. 39. The individual panels 1-1$^{IV}$ have a trapezoidal form with the panels located one above the other being of different sizes. In other words, in the vertical direction the area of each panel decreases. In this way trapezoidally shaped or triangularly shaped formwork elements can be erected which are flexible so that a partial surface of a conical structure can be enclosed.

Figure 40:
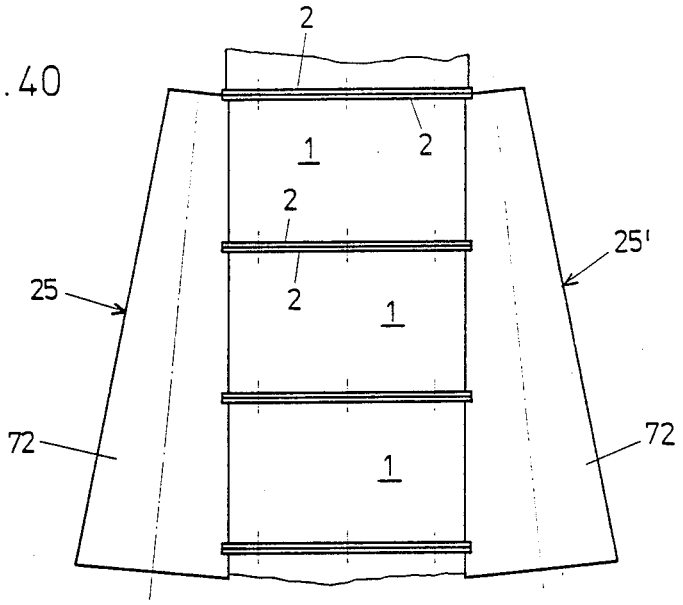
FIG. 40 is a plan view of a trapezoidally shaped formwork assembly, however, with the formwork panels being rectangularly shaped and the girder-like members having a trapezoidal shape.
Figure 41:
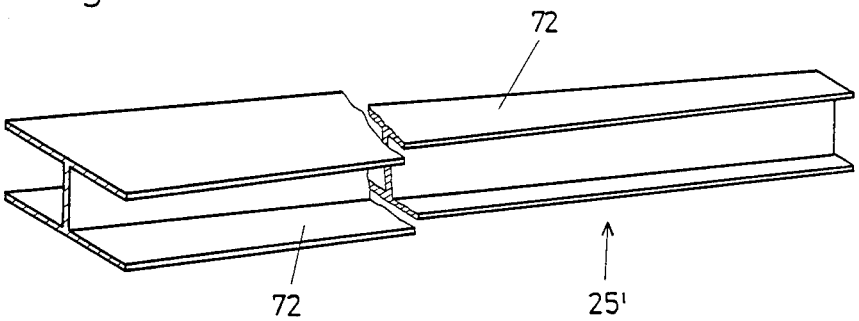
FIGS. 41 and 42 are perspective views of partially trapezoidally shaped or wedge-shaped flanges of the girder-like members shown in FIG. 40.
Figure 42:
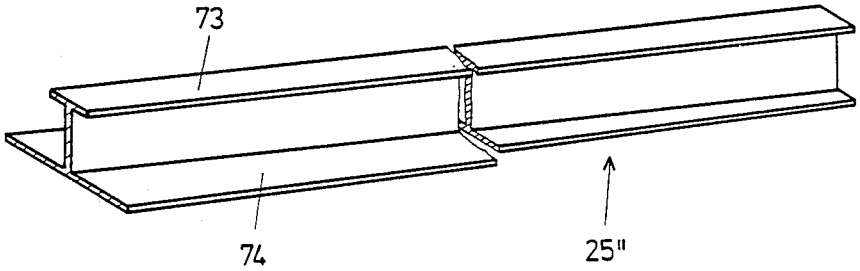

Another arrangement of trapezoidally shaped or triangularly shaped formwork elements is set forth in FIG. 40. In this arrangement the formwork panels each have the same size and are connected to one another, however, the girder-like members 25' have wedge-shaped flanges 72 extending in the long direction of the member. Such a girder-like member is depicted in a perspective view in FIG. 41. It is also possible to provide one flange 73 with parallel edges and the other flange 74 with edges converging in the long direction of the girder 25'', note FIG. 42. From the foregoing description it can be appreciated that the formwork panels in the formwork assembly can be arranged so that the support members 2 or 61 extend vertically or horizontally, note the horizontal arrangement of the support members in the formwork assembly shown in FIGS. 39 and 40.

While specific embodiments of the invention have been shown and described in detail to illustrate the application of the inventive principles, it will be understood that the invention may be embodied otherwise without departing from such principles.

I claim:

1. Formwork assembly for constructing structural members of a poured concrete, comprising formwork panels with a concrete forming surface thereof made up of an elastically deformable material, said concrete forming surface being bendable within the elastic limit thereof for fabricating curved formwork panels, said formwork panels having an inside surface defining the concrete formwork surface and an outside surface and having a pair of spaced apart vertically extending opposite first ends, and a pair of spaced apart horizontally extending opposite second ends, each said opposite first end having a similar length, vertically extending support members mounted on said outside surface at each of said opposite first ends and extending approximately for the length of said opposite first ends, each said support member having a lower end and an upper end and girder members extending horizonatally between said spaced apart opposite first ends and combining with said support members for interconnecting vertically adjoining said formwork panels into the formwork assembly, wherein the improvement comprises that said formwork panels are located in a plurality of horizontally extending rows with said horizontally extending rows located one above the other with said second ends of the vertically adjacent said formwork panels being in close relation to one another, the lower and upper ends of said support members combine with the adjacent outside surface at the second ends of said formwork panels on which they are mounted to form a groove section, and the groove sections on vertically adjacent said formwork panels located one above the other combine to form recesses into which said girder members fit for supporting and interconnecting said formwork panels making up the formwork assembly, said girder members project outwardly from said outside surface and have a flange extending vertically and bearing against and in an overlapping manner the outside surface of said formwork panels at the second ends thereof for supporting and shaping said formwork panels, and one of said recesses and said girder members fitted into said recesses having a generally vertically extending wedge shaped surface located within said recesses for securely interconnecting vertically adjacent said formwork panels.

2. Formwork assembly, as set forth in claim 1, wherein said formwork panels adjoining in the vertical direction have said support members in alignment with one another.

3. Formwork assembly, as set forth in claim 1, wherein said support members mounted at each of said vertically extending first ends are positioned along said opposite first ends whereby said support members on first ends of horizontally adjacent said formwork panels are in contacting relation.

4. Formwork assembly, as set forth in claim 3, wherein additional said vertically extending support members are provided on the outside surface of said formwork panel and said support members on the outside surface of said formwork panel are equidistantly spaced apart between said support members at the vertically extending opposite first ends.

5. Formwork assembly, as set forth in claim 4, wherein said horizontally extending opposite second edges having a length equal to 3.14 m or a whole number multiple of 3.14 m.

6. Formwork assembly, as set forth in claim 1, wherein the groove sections at upper and lower ends of said vertically extending support members each comprise a notched section having a plurality of surfaces with one of said surfaces being a wedge-shaped surface adjacent the outside surface of said formwork panel on which said support members are mounted.

7. Formwork assembly, as set forth in claim 6, wherein one surface of said wedge-shaped notched section is formed by the outside surface of said formwork panel.

8. Formwork assembly, as set forth in claim 7, wherein the notched sections in adjacent ends of said support members on said formwork panels adjoining one another in the vertical direction combine to form one said groove section with said girder members fitted into said groove sections in locking engagement therewith.

9. Formwork assembly, as set forth in claim 8, wherein the width of said girder members positioned within said grooves is greater in the vertical direction than twice the vertical dimension of each said notched sections forming said grooves.

10. Formwork assembly, as set forth in claim 8, wherein said girder member is an I-beam shaped member having a horizontally extending web and a vertically extending flange extending transversely of and located at each end of said web with one of said flanges fitted into locking engagement with said groove sections.

11. Formwork assembly, as set forth in claim 8, wherein said girder member is a T-shaped section having a vertically extending flange-like head and a horizontally arranged web extending centrally from said flange-like head, and said flange-like head fits in locking engagement within said groove sections.

12. Formwork assembly, as set forth in claim 1, wherein said girder member is a tension member and is formed of a plurality of horizontally extending sections, each said section having sleeves at the ends thereof with the axes of the sleeves extending parallel with the axis of the girder member, and connecting members arranged to extend through the sleeves located at the adjoining ends of adjacent and aligned said girder member sections for connecting said sections together.

13. Formwork assembly, as set forth in claim 1, wherein said girder member is formed of a plurality of horizontally extending sections one following the other and forming a horizontally arranged compression member with each said section having a pressure plate at one end thereof and the other end of the said section having an eccentrically mounted pivotally displaceable connector for engagement within said pressure plate of an adjoining said section for effecting a connection between said girder member sections.

14. Formwork assembly, as set forth in claim 10, wherein said I-beam section is formed of two parts with one part being a first T-shaped part with a head section and a web section extending perpendicularly from the center of said head section, said web section having a row of holes therethrough spaced from said head section, the other part is a second T-shaped part with a head section extending generally parallel with and spaced from the head section of said first T-shaped part and having a web extending along and perpendicularly to said head section thereof, and with a plurality of holes extending through said webs of said first and second T-shaped parts and said two parts being arranged with said webs thereof being in overlapping relation with the holes therethrough aligned and with connector members extending through and connecting said two parts together.

15. Formwork assembly, as set forth in claim 1, wherein said girder member comprises a vertically extending flange arranged to abut the outside surface of adjoining said formwork panels, a protrusion extending outwardly from said flange on the side thereof facing said formwork panels and said formwork panels being disposed in vertically spaced relation so that said protrusion extends between adjacent horizontally extending edges of said panels and the dimension of said protrusion extending outwardly from said flange corresponds to the dimension of said formwork panels between the outside and inside surfaces thereof so that the surface of said protrusion spaced from said flange is flush with the inside surfaces of said formwork panels.

16. Formwork assembly, as set forth in claim 2, wherein the lower and upper ends of said vertically extending support members are offset inwardly from horizontally extending edges on said formwork panels.

17. Formwork assembly, as set forth in claim 1, wherein said support members are angle sections having a first leg and a second leg with said first leg disposed in contact with the outside surface of said formwork panel and having a plurality of openings therethrough spaced apart in the vertical direction of said angle section, eyes secured to the outside surface of said formwork panel and spaced apart corresponding to the spacing of said openings through said first leg of said angle section, said eyes being welded to said outside surface of said formwork panel and extending through the openings in said first leg of said angle section, and wedge members insertable through said eyes extending through the openings in said angle section for securing said support member to said formwork panel.

18. Formwork assembly, as set forth in claim 1, wherein said girder member comprises a horizontally arranged I-shaped member with a horizontal web and a pair of vertical flanges each located at an opposite end of said web, and at least one of said flanges having converging edges extending in the horizontal direction of said girder member.

* * * * *